United States Patent [19]

Sako et al.

[11] Patent Number: 4,788,518

[45] Date of Patent: Nov. 29, 1988

[54] THERMALLY-SENSITIVE OVERCURRENT PROTECTIVE RELAY INCLUDING WIRE CONNECTION TERMINAL

[75] Inventors: Yuji Sako; Haruhiko Ito, both of Aichi; Mineo Sano, Mie, all of Japan

[73] Assignee: Mitsubishi Denki Kabushiki Kaisha, Tokyo, Japan

[21] Appl. No.: 110,083

[22] Filed: Oct. 16, 1987

[30] Foreign Application Priority Data

Oct. 17, 1986 [JP] Japan ..... 61-159004[U]

[51] Int. Cl.[4] ..... H01H 71/16; H01H 37/70

[52] U.S. Cl. ..... 337/49; 337/45

[58] Field of Search ..... 337/48, 49, 45, 52, 337/53, 56, 59

[56] References Cited

U.S. PATENT DOCUMENTS 4,635,020 1/1987 Sako ..... 337/49

4,652,847 3/1987 Sako ..... 337/49

FOREIGN PATENT DOCUMENTS 1250773 10/1971 United Kingdom .

*Primary Examiner*—H. Broome

*Attorney, Agent, or Firm*—Lowe, Price, LeBlanc, Becker & Shur

[57] ABSTRACT

A thermally-sensitive overcurrent protective relay includes a housing case, a bimetal strip bendable in response to an operating current flowing through a control circuit of the overcurrent protective relay, and a movable contact biased by a spring to form a toggle mechanism operable in response to the bending action of the bimetal. A lever supporting bracket mechanically supports the movable contact at a fulcrum portion and electrically connects the movable contact to a terminal. The terminal is mounted in the housing case to conduct current to the control circuit through a contact spring for electrically connecting the lever supporting bracket. This lever supporting member includes a trip current adjusting mechanism adapted to be rotated at its end portion by turning an adjusting screw for adjustment of the operation current.

1 Claim, 1 Drawing Sheet

THERMALLY-SENSITIVE OVERCURRENT PROTECTIVE RELAY INCLUDING WIRE CONNECTION TERMINAL

BACKGROUND OF THE INVENTION

1. Field of the Invention

The present invention generally relates to a thermally-sensible overcurrent protective relay, and more particularly, to an overcurrent protective relay including a wire connecting terminal.

2. Description of the Related Art

Thermally-sensible overcurrent protective relays have been widely used to prevent the overcurrent from being flown through a main device, e.g., induction motors during overload condition. These overcurrent protective relays are known in the field from, for instance, U.S. Pat. Nos. 4,635,020 and 4,652,847 issued to the Applicant.

One of the conventional thermally-sensible overcurrent protective relays will now be described with reference to FIGS. 1 through 7.

FIG. 1 is a front view with a cover 2 removed; FIG. 2 is a sectional view taken along a line A—A in FIG. 1; FIG. 3 is a sectional view taken along a line B—B in FIG. 1; FIG. 4 is a sectional view taken along a line C—C in FIG. 1; FIG. 5 shows a movable contact element; FIG. 6 shows an actuating lever; and FIG. 7 is a perspective view illustrating basic component elements of a snapping inverter.

In FIG. 1, there are shown a case 1, a cover 2, bimetals 3 provided for individual phases (three phases in this example), and heaters 4 wound around the bimetals 3 respectively to generate heat when a main circuit current flows therein. When heated by the heater 4, the bimetal 3 is deformed with a curvature as represented by a dotted line in FIG. 1. A load-side main circuit terminal 5 (FIG. 4) has a tongue 5A to which an upper end of the bimetal 3 is joined and secured. The load-side main circuit terminal 5 is anchored to the case 1 by means of a clamp screw 6, and a terminal screw 7 for connecting a load-side main circuit (external circuit) is fastened to one end 5B of the terminal 5. Also, a lower end 4B of the heater 4 is electrically connected to a lower end of the bimetal 3 by some suitable means such as welding.

In a main circuit terminal for a power supply side 40, as shown in FIG. 4, an upper end 4A of the heater is electrically connected to its one end 40A by welding or similar means. Meanwhile, a left end 40B of the main circuit terminal 40 is screwed to a terminal of a power supply circuit used for an electromagnetic contactor (not shown) and so forth. A communicating plate 8 is kept in engagement with the fore end of the bimetal 3 of each phase so as to transmit the deformation of the bimetal 3. In the example of FIG. 1, the communicating plate 8 is so disposed that its left end depresses a lower end of a temperature compensating bimetal 9. Further, an actuating lever 10 is disposed to be rotatable around a shaft 11 with an upper end of such temperature compensating bimetal 9 anchored to the lever 10 (see FIG. 1).

The shaft 11 is held at its two ends by a lever supporting member 12 as shown in FIG. 3. The lever supporting member 12 is retained, at an inner corner 12A of its L-shaped bend, in abutment against an edge 1A of the case 1 and is thereby held at a fulcrum while being pressed against an adjusting screw 13 through a first tongue 12B. In the meanwhile, a second tongue 12C is elastically urged leftward, as viewed in FIG. 1, by a leaf spring 14.

Consequently, the lever supporting member 12 is rotatable around the edge 1A by turning a control knob 15 disposed above the adjusting screw 13. In addition, the shaft 11 attached to the lever supporting member 12 is positionally changed substantially in the horizontal direction in FIG. 1, thereby controlling the operating current in response to the curvature of the bimetal 3 curved by the current generated from the heater 4.

A movable contact element 16 is composed of a thin metal plate having sufficient elasticity and conductivity. As illustrated in FIG. 5, the movable contact element 16 is produced by punching a plate to have an inner beam portion 16A and outer beam portions 16B. A U-shaped leaf spring 17 is interposed between the fore end of the inner beam portion 16A and the outer beam portions 16B in such a manner as to depress the contact element 16 with elastic urge. A contact portion 16C of the movable contact element 16 is disposed opposite to and in abutment against a fixed contact element 18 for a normally closed contact, thereby constituting a normally closed contact mechanism. Then a lower end 16E of the movable contact element 16 shown in FIG. 5 is clinched firmly via a through hole 16G to a normally closed movable terminal 19 shown in FIG. 1. This terminal 19 is anchored to the case 1 by means of a clamp screw 20 as illustrated in FIG. 3.

The inner beam portion 16A of the movable contact element 16 is inserted into a substantially T-shaped slit 10A formed at the fore end, or tip of the actuating lever 10 shown in FIG. 6. An upper end 16F extending from the outer beam portion 16B of the movable contact element 16 is engaged with a groove 21A formed at the left end of a cross bar 21. The cross bar 21 is guided by the case 1 to be movable horizontally, as viewed in FIG. 1.

Each of a normally-open fixed contact element 24 and a normally-open movable contact element 25 is composed of a thin metal plate having sufficient elasticity and conductivity. Such two contact elements 24 and 25 are clinched and fastened respectively to a normally open fixed terminal 22 and a normally-open movable terminal 23 shown in FIG. 2. A back surface 25A of the upper distal end of the normally-open movable contact element 25 in its positional change is disposed in abutment against a projection 21G of the cross bar 21. A reset bar 26 is held slidably by the case 1 and is displaceable vertically in FIG. 1. Normally the reset bar 26 is elastically urged at its edge 26C upward by a return spring 27 and is retained at an upper-limit halt point. In this state, a lower vertical plane 26D of the reset bar 26 is kept in abutment against a curved portion 24A formed on a back surface of the normally open fixed contact element 24. Then, an inclined portion 26A of the reset bar 26 is slid and depressed against such curved portion 24A in accordance with the downward displacement of the reset bar 26, thereby displacing the normally-open fixed contact element 24 rightward in FIG. 1.

When such conventional thermally-sensible overcurrent protective relay is used in an auto-reset system, first the reset bar 26 is depressed downward to displace a changeover plate 30 leftward in FIG. 1, so that the fore end of the changeover plate 30 is inserted into a lock hole 26B formed in the reset bar 26, and the protrusion 1B of the case 1 is fitted into a recess on the bottom of the changeover plate 30, whereby the reset bar 26 is restricted with respect to its upward return.

In the conventional thermally-sensible overcurrent protective relay of the structure mentioned, the following operation is performed.

In FIG. 4, a main circuit current flows from the main circuit terminal for the power supply side 40 via the heater 4 and the bimetal 3 to the load side main circuit terminal 5. An electric wire (not shown) is connected to the terminal screw 7 fastened to one end 5B of the load-side main circuit terminal 5 and is further connected to a load (not shown) such as an induction motor. Consequently, the main circuit current becomes equivalent to the load current. Due to the Joule heat loss caused by such main circuit current in the bimetal 3 and the heater 4, the bimetal 3 is heated and curved as represented by a dotted line in FIG. 1.

Upon occurrence of an overcurrent condition in the load, the main circuit current becomes higher to further increase the curvature (bending curve) of the bimetal 3 represented by the dotted line in FIG. 1, hence causing its further displacement leftward. As a result, the communicating plate 8 is depressed by the fore end of the bimetal 3 and is thereby displaced leftward in FIG. 1. In response to such leftward displacement of the communicating plate 8, a coupled assembly of the temperature compensating bimetal 9 and the actuating lever 10 is pressed by the left end of the communicating plate 8 and is thereby rotated clockwise around the shaft 11, so that the inner beam portion 16A of the movable contact element 16 in abutment against the periphery of the substantially T-shaped slit 10A at the fore end of the actuating lever 10 is bent rightward in FIG. 1.

When the inner beam portion 16A thus bent and displaced has reached a dead center point determined by the relationship between the elastic urge of the U-shaped leaf spring 17 and the spring force of the outer beam portion 16B of the movable contact element 16 for returning to the former state, the movable contact element 16 is suddenly inverted to induce leftward jump of the outer beam portion 16B and rightward jump of the inner beam portion 16A in FIG. 1.

Therefore, the normally-closed contacts held in electric conduction are opened by the abutment of the contact portion 16C against the fixed contact element 18 for the normally-closed contact, hence interrupting the main circuit.

Meanwhile, the cross bar 21 is pulled by an upper end 16F of the outer beam portion 16B and is thereby shifted leftward in FIG. 1, so that the projection 21G serves to displace the normally-open movable contact element 25 leftward. Consequently, the normally-open movable contact element 25 is brought into abutment against the normally-open fixed contact element 24 to eventually cause electric conduction.

Therefore, by connecting the normally-closed contact in series with the operating coil circuit (not shown in detail) of an electromagnetic contactor (not shown) which switches on and off the main circuit, it is rendered possible to interrupt and protect the main circuit upon occurrence of an overcurrent condition in the load (not shown) such as an induction motor. Furthermore, an overload alarm signal may be produced by connecting an alarm lamp or equivalent circuit in series with the normally-open contact.

After generation of thermal energy from the heater 4 is ceased as a result of interruption of the main circuit current and the bimetal 3 is cooled to resume the former state, both the normally-open and normally-closed contacts can be returned to the former positions thereof by external manual actuation to depress the reset bar 26 downward in FIG. 1. When the reset bar 26 is manually depressed downward in FIG. 1 against the elasticity of the return spring 27, the inciined portion 26A of the reset bar 26 presses rightward the curved back portion 24A of the normally open fixed contact element 24, which is thereby bent rightward in FIG. 1. Consequently, the normally movable contact element 25 held in abutment against the normally-open fixed contact element 24 is displaced rightward, so that the cross bar 21 is also displaced rightward in FIG. 1 with its projection 21G being pressed by the back surface 25A of the normally open movable contact element 25.

In the conventional thermally-sensible overcurrent protective relay as mentioned above, the following problems will be considered in the case of tightening the wire connecting terminal screw 90 of the terminal 19 for the normally-closed movable contact during the wiring connection (see FIG. 3).

The terminal 19 for the normally-closed movable contact is fixed by the tightening screw 20 so as to prevent the change in position due to the tightening operation of the terminal screw 90 shown in FIG. 3. However, the tightening torque of the terminal screw 90 exceeds that of the tightening screw 20, and there sometimes occurs a slight change in position (a change in rotational position about the axis of the tightening screw 20 as shown in FIG. 3). Since the movable contact 16 is electrically and mechanically connected with the terminal 19 for the normally-closed movable contact at a free end 16E (see FIG. 7) of the contact 16 by means of clinching or the like, the aforementioned slight change in rotational position is enlarged at the end (tongue 16F) of the movable contact 16, causing the shift of a reverse position. In other words, the shift of the reverse position causes the shift of the operational position of the bimetal 3, resulting in deterioration in a protective function against the overcurrent.

Accordingly, the present invention has been accomplished in an attempt to overcome the above conventional problems, and it is therefore an object of the present invention to provide a thermally-sensible overcurrent protective relay which achieves no shift in the protective operational point against the overcurrent even when the wire connecting terminal screw is tightened for the purpose of the connection to an external wiring.

SUMMARY OF THE INVENTION

To accomplish the above-described object, the thermally-sensible overcurrent protective relay 100 according to the invention comprises a housing case 1, a bimetal 3 bendable in response to current flowing through a main circuit of the overcurrent protective relay 100, a movable contact 56 adapted to conduct a reverse operation and forming a toggle mechanism operable; in response to the bending action of the bimetal 3, a lever supporting member 55 for mechanically supporting the movable contact 56 at its fulcrum portion and electrically connecting the movable contact 56, and a terminal for the movable contact fixed to the housing case 1 for supplying current to the control circuit through a contact spring 61 for electrically connecting the lever supporting member 55.

BRIEF DESCRIPTION OF THE DRAWINGS

For a better understanding of the invention as well as other objects and further features thereof, reference is made to the following description which is to be read in conjunction with the accompanying drawings, in which.

DETAILED DESCRIPTION OF THE PREFERRED EMBODIMENTS

General Description

Referring now to FIGS. 8 to 17, a description will be made of a thermally-sensible overcurrent protective relay 100 according to one preferred embodiment, which is directed to the reliable wire connecting terminal and overcurrent protective functions of the movable contact 16.

Figure 8:
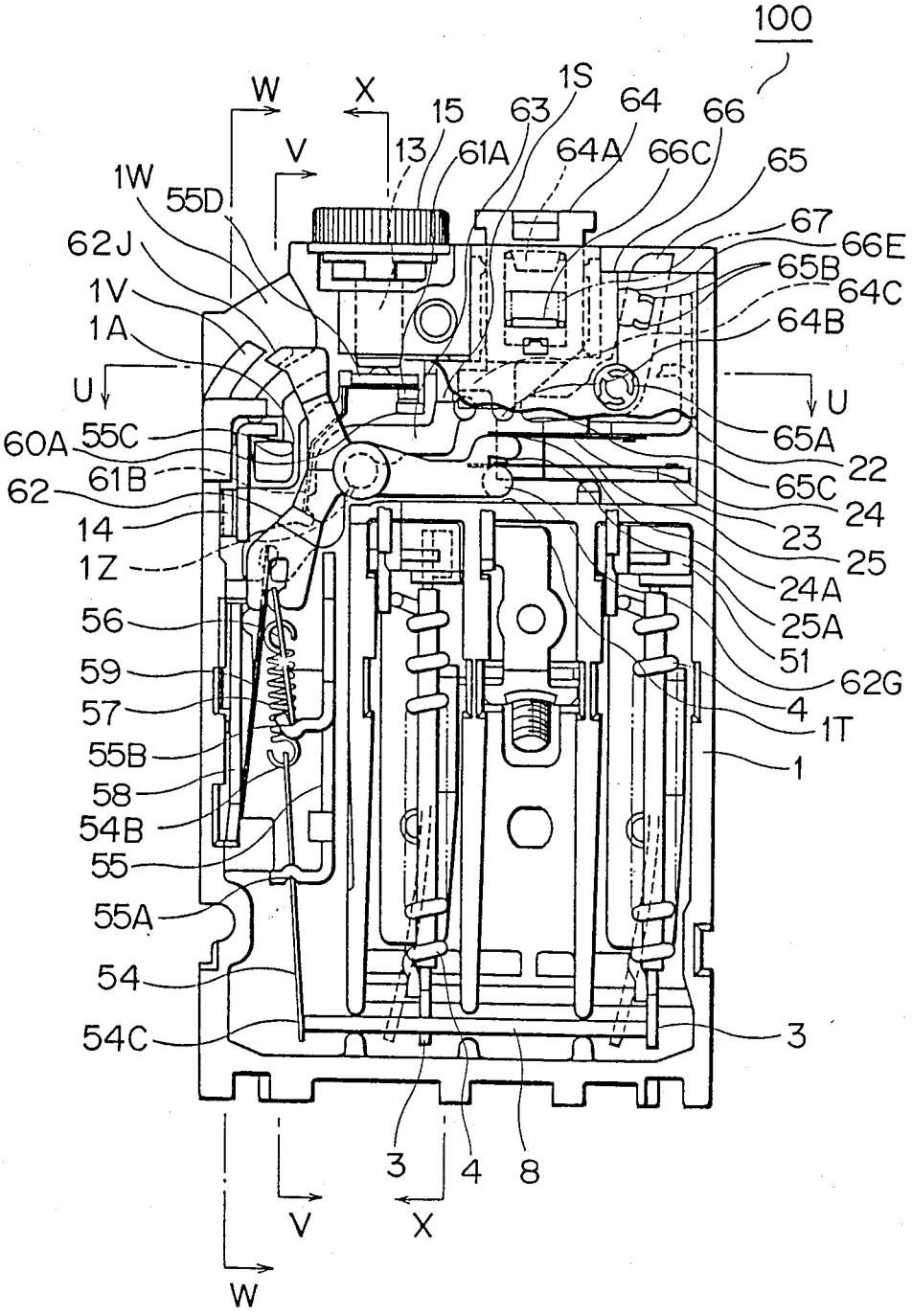
FIG. 8 a longitudinal sectional view of a thermally-sensible overcurrent protective relay, according to a first embodiment of the present invention, shown with its cover removed.
Figure 9:
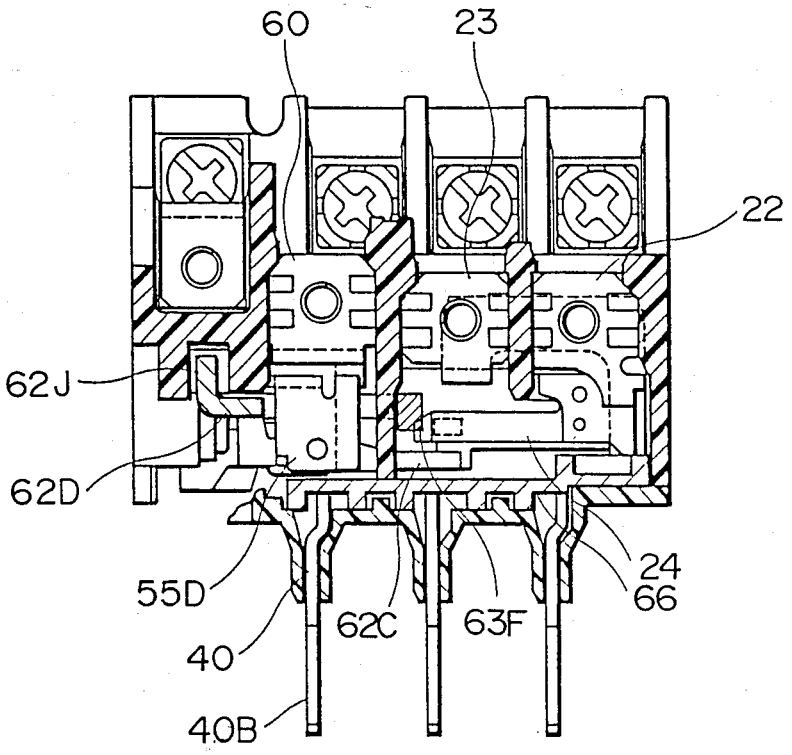
FIG. 9 is a cross-sectional view taken along a line U—U in FIG. 8.
Figure 10:
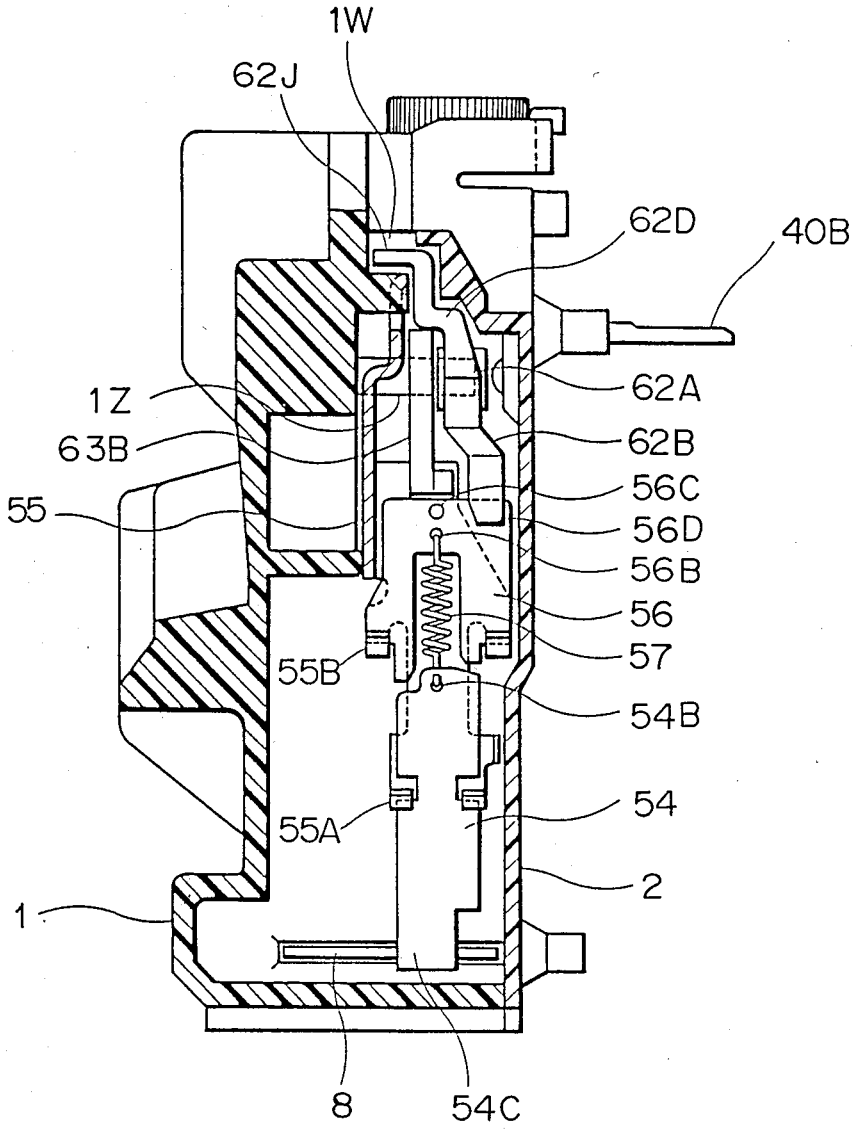
FIG. 10 is a longitudinal sectional view taken along a line V—V in FIG. 8.
Figure 11:
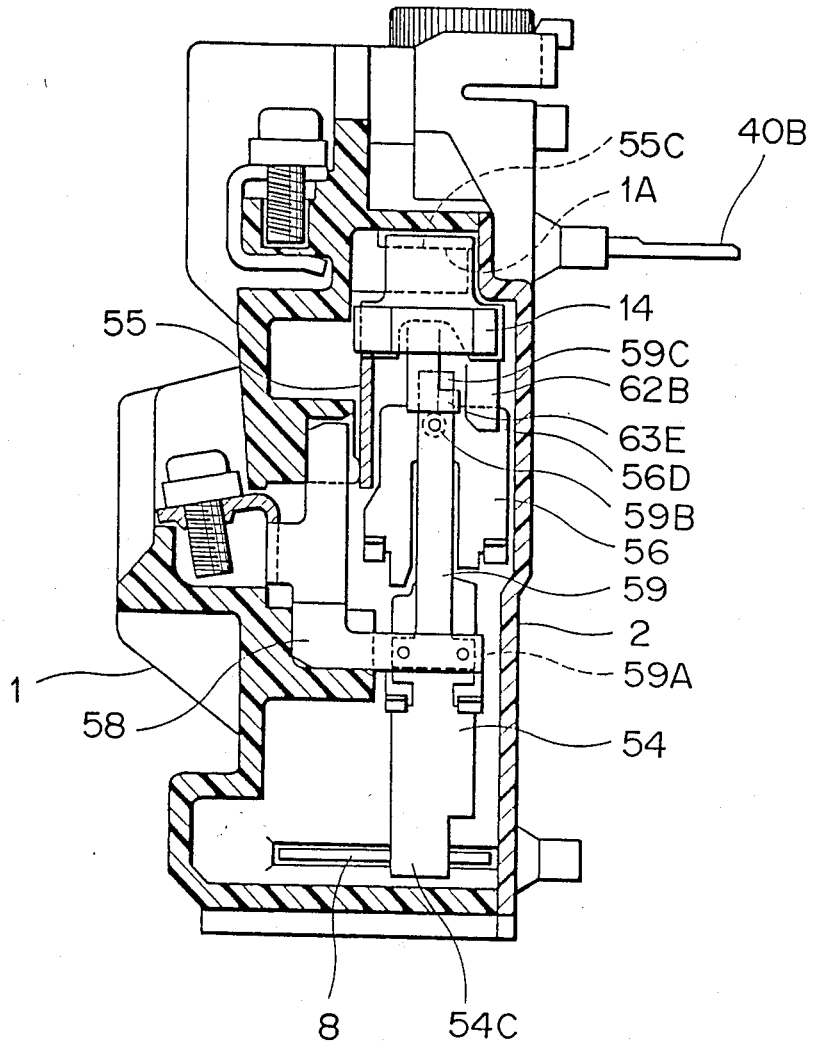
FIG. 11 is a longitudinal sectional view taken along a line W—W in FIG. 8.
Figure 12:
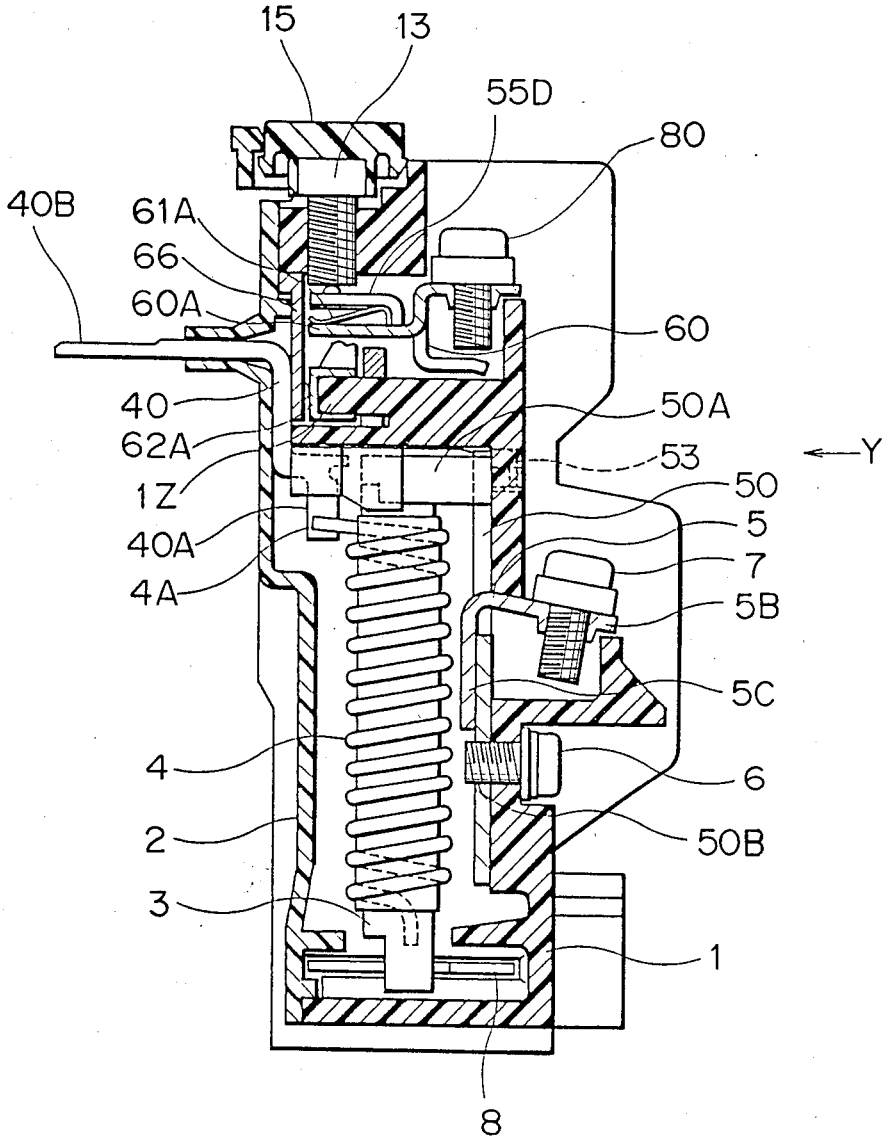
FIG. 12 is a longitudinal sectional view taken along a line X—X in FIG. 8.
Figure 13A:
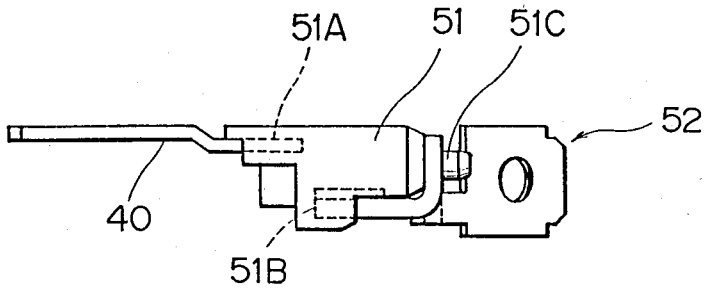
FIGS. 13A through 13D are respectively a plan view, a front view, a left side view and a right side view of a heating element employed in the thermally-sensible overcurrent protective relay of FIG. 8.
Figure 13B:
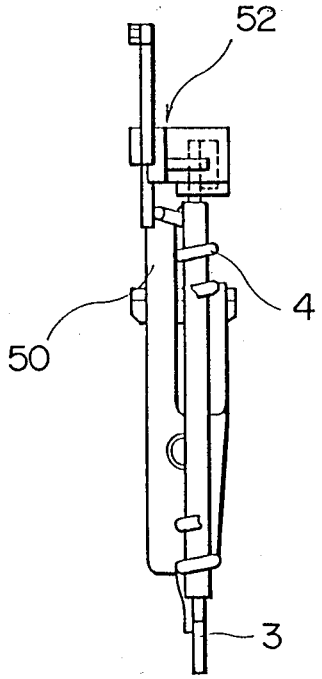
Figure 13C:
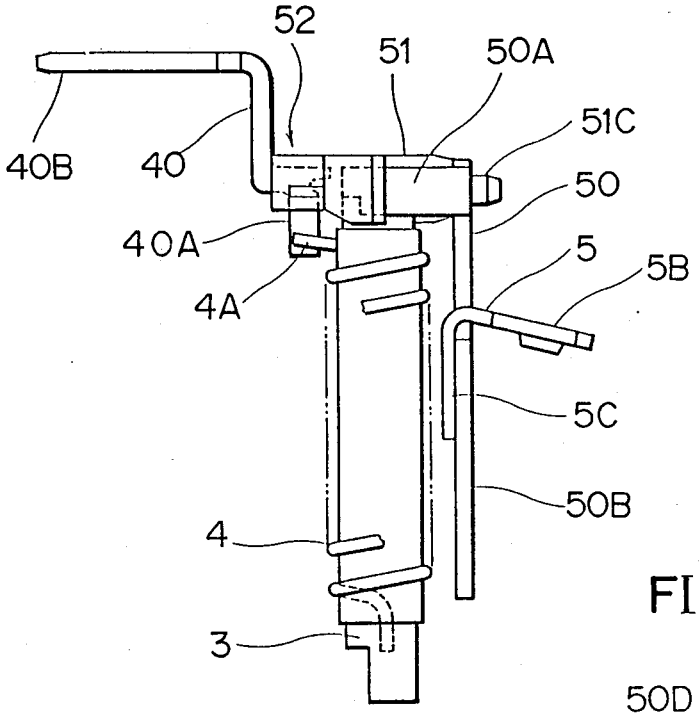
Figure 13D:
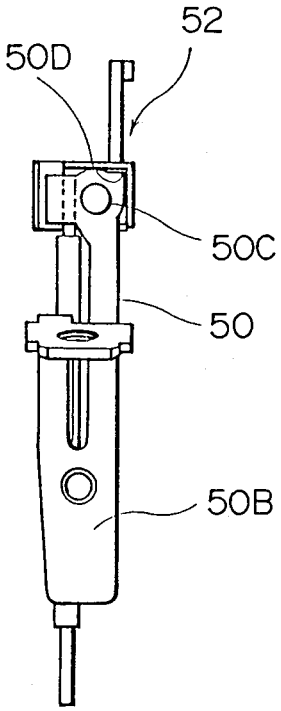
Figure 14:
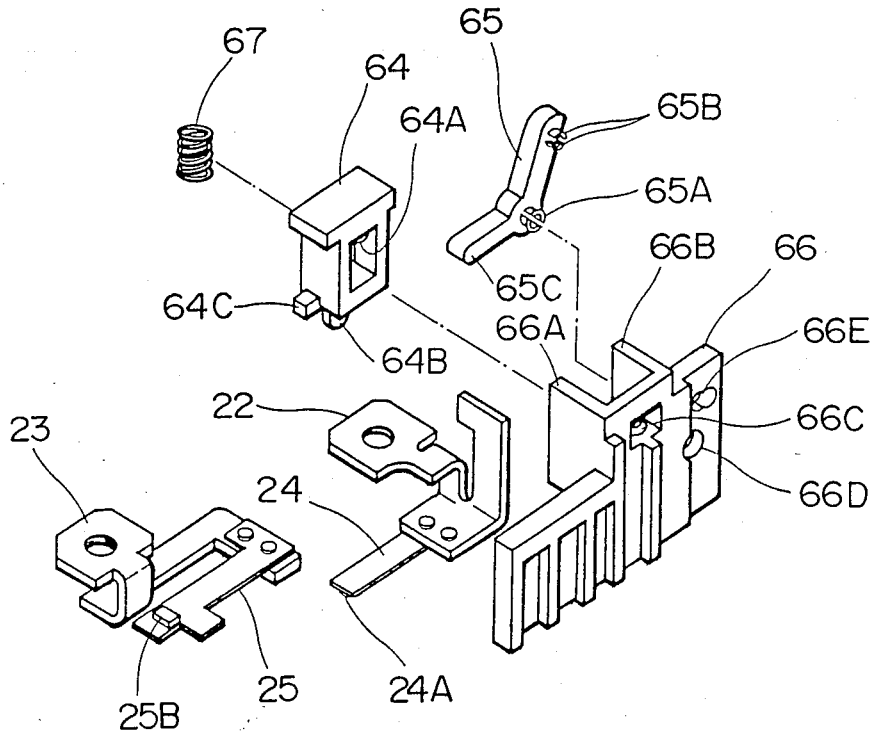
FIG. 14 is an exploded perspective view of component elements of normally-open contacts and a reset mechanism employed in the thermally-sensible overcurrent protective relay of FIG. 8.
Figure 15:
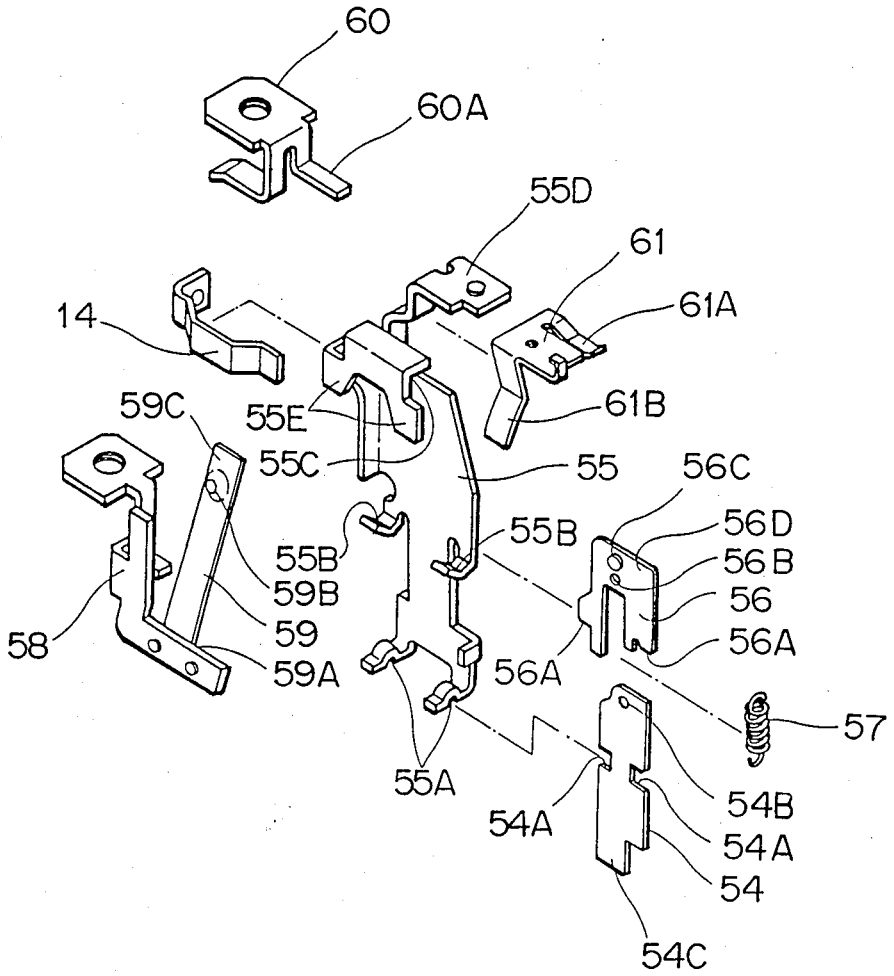
FIG. 15 an exploded perspective view of component elements of normally-closed contacts and a snapping inverter employed in the thermally-sensible overcurrent protective relay of FIG. 8.
Figure 16:
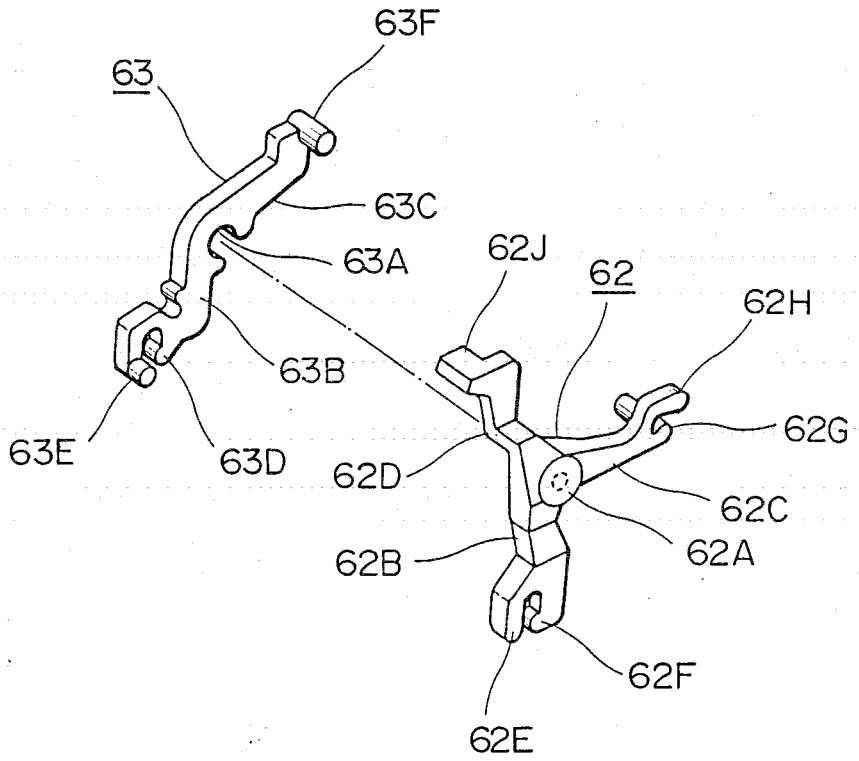
FIG. 16 a perspective view of a first lever and a second lever employed in the thermally-sensible overcurrent protective relay of FIG. 8.
Figure 17:
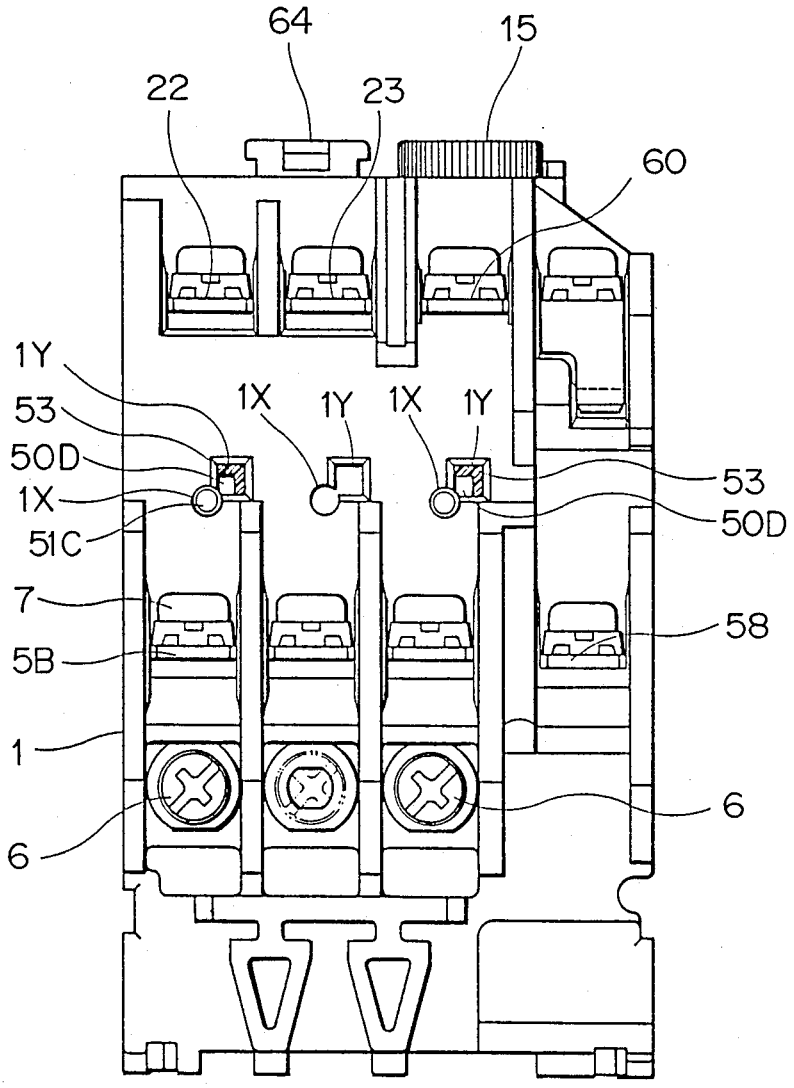
FIG. 17 is a rear view of the thermally-sensible overcurrent protective relay of FIG. 8.

FIG. 8 is a front view of the thermally-sensible overcurrent protective relay 100 shown with its cover 2 removed; FIG. 9 is a cross-sectional view taken along a line U—U in FIG. 8; FIG. 10 is a longitudinal sectional view taken along a line V—V in FIG. 8; FIG. 11 is a longitudinal sectional view of basic component elements taken along a line W—W in FIG. 8; FIG. 12 is a sectional view taken along a line X—X in FIG. 8; FIGS. 13A through 13D are respectively a plan view, a front view, a left side view and a right side view of a heating element; FIG. 14 is an exploded perspective view of component elements in normally-open contacts and a reset mechanism; FIG. 15 is an exploded perspective view of component elements in normally-closed contacts and a snapping inverter; FIG. 16 is an exploded perspective view of a first lever and a second lever; and FIG. 17 is a rear view of the thermally-sensible overcurrent protective relay 100 seen from the direction of an arrow Y in FIG. 12.

It should be noted that in FIGS. 8 through 17, the component elements corresponding to those shown in FIGS. 1 through 7 are denoted by the same reference numerals.

Construction of Overcurrent Protective Relay Circuit Terminals

In FIG. 8, each of bimetals 3 for individual phases (three phases in this embodiment also, but the center bimetal cannot be observed) is heated by a heater 4 energized by a control circuit current and is thereby deformed with a curvature as represented by a dotted line in FIG. 8. That is, leftward deformation is induced, as viewed in FIG. 8.

A load-side main circuit terminal 5 (FIG. 12) is shaped into an "L", and a terminal screw 7 for connecting a load-side main circuit (external circuit) is screwed to one end 5B of such L-shaped terminal 5, while another end 5C thereof is connected electrically and mechanically to a bimetal retainer, or supporting member 50 by means of welding or the like. The bimetal retainer 50 is joined and anchored, at its tongue 50A, to an upper end of the bimetal 3 both electrically and mechanically by welding or similar means.

As illustrated in FIGS. 12 and 13, an upper end 4A of the heater 4 is electrically connected to one end 40A of a main circuit terminal for a power supply side 40 by means of welding or the like. Meanwhile, a left end 40B of the terminal 40 is screwed to a terminal of a power supply circuit used for an electromagnetic contactor (not shown) and so forth.

Heating Element

In FIG. 13, a heater holder 51 made of heat-resistant resin supports the main circuit terminal for the power supply side 40 in its first groove 51A to secure the same. There is also formed a second groove 51B in the heater holder 51 for supporting and securing the joint of a tongue 50A of the bimetal retainer 50 and the upper end of the bimetal 3. The heater holder 51 further has, at its right end, as viewed in FIG. 13A, a columnar pin 51C which is inserted into a through hole 50C formed at the upper end of the bimetal retainer 50. As illustrated in FIG. 13, the heater holder 51 has a function of integrally joining the peripheral component parts of the main circuit and the heating element including the main circuit terminal for the power supply side 40, the bimetal retainer 50, the bimetal 3 and the heater 4. The heating element 52 thus integrally assembled as illustrated in FIG. 13 is housed in a case 1 shown in FIG. 8. In this stage, the fore end, or tip of the pin 51C of the heater holder 51 is inserted into a through hole 1X formed in the case 1 of FIG. 17 which is a view from the direction of an arrow Y in FIG. 12. After the respective fore ends of the bimetals 3 for the individual phases are so adjusted as to be positionally coincident with one another in a rotatable state around the pins 51C, the lower end 50B of the bimetal retainer 50 is anchored to the case 1 by the use of a clamp screw 6 as illustrated in FIG. 12. Subsequently, the hole 1Y in the case 1 of FIG. 17 is filled with a bonding resin 53. Then, the rotational position of the bimetal 3 shown in FIG. 8 is completely established as the bonding resin 53 is hardened in the space formed between an angular portion 50D of the bimetal retainer 50 and the hole 1Y as represented by the hatching in FIG. 17.

Communicating Plate and Lever Supporting Member

A communicating plate 8 for transmitting the bending torque of the heated bimetal 3 is kept in engagement with the fore end of the bimetal 3 of each phase, and the plate 8 is so disposed that its left end presses a lower end 54C of a temperature compensating bimetal 54 as illustrated in FIG. 8. A lever supporting member 55 has a pair of first fulcrums 55A in its lower portion and a pair of second fulcrums 55B in its upper portion. A normally-closed movable contact element 56 is composed of an electrically conductive thin metal plate.

A pair of edges 54A (see FIG. 15) formed substantially at the center of the temperature compensating bimetal 54 are kept in abutment against the first fulcrums 55A of the lever supporting member 55, and a pair of edges 56A formed in lower portions of a normally-closed movable contact element 56 are kept in abutment against the second fulcrums 55B of the lever supporting member 55. Further, a tension coil spring 57 is interposed between a through hole 54B formed in an upper portion of the temperature compensating bimetal 54 and a through hole 56B formed in the normally-closed movable contact element 56.

The lever supporting member 55 is retained, at an inner corner 55C of its L-shaped bend, in abutment against the edge 1A of the case 1 and is thereby held at a fulcrum while being depressed against an adjusting screw 13 through a first tongue 55D. In the meanwhile, a second tongue 55E is elastically urged leftward in FIG. 1 by a leaf spring 14.

Consequently, the lever supporting member 55 is rotatable around the edge 1A of the case 1 in FIG. 8 by turning a control knob 15 disposed above the adjusting screw 13, so that the lower end 54C of the temperature compensating bimetal 54 can be positionally varied substantially in the horizontal direction, as viewed in FIG. 8. Thus, the operating current can be adjusted in response to the amount of the curvature of the bimetal 3.

Contact Elements

A normally-closed fixed contact element 59 (see FIG. 15) is composed of a thin metal plate having sufficient elasticity and conductivity, and is connected firmly at its lower portion 59A to a normally-closed fixed terminal 58 both electrically and mechanically by clinching or similar means. A contact point 59B provided on an upper portion of the fixed contact element 59 is disposed opposite to a contact point 56C on an upper portion of the normally-closed movable contact element 56, thereby constituting a normally-closed contact mechanism which functions with mutual abutment or separation of such two contact points.

The normally-closed fixed terminal 58 is pressed into and anchored to the case 1. Meanwhile, a normally-closed movable terminal 60 is also pressed into and anchored to the case 1, and its tongue 60A is kept in touch with a first spring portion 61A of a contact spring 61 attached to the first tongue 55D of the lever supporting member 55. The contact spring 61 is composed of a thin metal plate having sufficient elasticity and conductivity, and power supply to the movable element of the normally closed contact is executed via a path extending sequentially from the normally-closed movable terminal 60 through the contact spring 61 and the lever supporting member 55 to the normally-closed movable contact element 56.

In FIGS. 8 and 9, the normally-open fixed terminal 22 and the normally-open movable terminal 23 are pressed into and anchored to the case 1. Each of the normally open fixed contact element 24 and the normally open movable contact element 25 is composed of a thin metal plate having sufficient elasticity and conductivity, and the right ends of such contact elements 24 and 25 are connected respectively to the normally-open fixed terminal 22 and the normally-open movable terminal 23 both electrically and mechanically by clinching or similar means.

The normally-open fixed contact element 24 and the normally-open movable contact element 25 have, at the respective left ends, a contact point 24A and a contact point 25A which are brought into mutual abutment or separation to constitute a normally-open contact mechanism. Moreover, the normally-open movable contact element 25 is actuated by a first lever 62 constituting a communicating means which operates the normally-closed contacts and the normally-open contacts in an interlocking manner.

First Lever

The first lever 62 is substantially Y-shaped as illustrated in the perspective view of FIG. 16 and is held rotatably with its central tubular portion 62A fitted to a shaft 1Z (see FIG. 8) projecting in the case 1. The first lever 62 has a first arm 62B, a second arm 62C and a third arm 62D extending in three directions from the central tubular portion 62A. The fore end, or tip of the first arm 62B is divided into two lobes 62E and 62F which hold the distal end 56D (see FIG. 11) of the movable contact element 56 therebetween. The fore end of the second arm 62C is divided into two lobes 62G and 62H between which the distal end of the normally-open movable contact element 25 (see FIG. 8) is interposed. Then, the fore end of the third arm 62D is shaped into a bent display tip 62J as illustrated in FIG. 16, and such display tip 62J projects toward a position corresponding to a window 1W in the case 1 (see FIG. 8).

Second Lever

As illustrated in FIG. 16, a second lever 63 has a semicircular tubular portion 63A substantially at its center in such a manner as to be rotatable with respect to the projecting shaft 1Z in the case 1 similarly to the first lever 62. The second lever 63 further has a first arm 63B and a second arm 63C extending in two different directions from the tubular portion 63A.

The fore end of the first arm 63B of the second lever 63 is divided into two protrusions 63D and 63E with a space formed therebetween, and the distal end 59C (see FIG. 15) of the normally-closedfixed contact element 59 is held in such space. Meanwhile, the fore end 63F of the second arm 63C is so disposed as to be depressed by an undermentioned reset bar 64 shown in FIG. 14. Accordingly, the second spring portion 61B of the contact spring 61 serves to push substantially a central portion of the first arm 63B of the second lever 63 leftward, as viewed in FIG. 8. The second lever 63 is elastically urged counterclockwise around the projecting shaft 1Z and is kept in abutment against the case 1 while being retained by a stopper 1S disposed in the case 1.

Reset Mechanism

A reset bar 64 and a changeover lever 65 shown in FIG. 14 are attached to the case 1 after being united with a reset bar case 66. The two sides of the reset bar 64 are slidably supported by guides 66A and 66B of the reset bar case 66 and are rendered vertically shiftable in FIG. 8. A return spring 67 compressed for elastic urge is interposed between a spring socket 64A in the reset bar 64 and a spring socket 66C in the reset bar case 66, so that the reset bar 64 is elastically urged upward by the return spring 67.

A first boss 64B formed in a lower portion of the reset bar 64 is so positioned as to press the upper surface of the normally-open fixed contact element 24, and a second boss 64C is so positioned as to press the fore end 63F of the second arm 63C of the second lever 63.

Contact Recovery Mechanism

For changing the recovery or reset system from a manual mode to an automatic mode posterior to the contact operation, the changeover lever 65 is so attached that its split pin 65A is fitted into a pin hole 66D formed in the reset bar case 66, whereby the changeover lever 65 is rendered rotatable around the pin hole 66D. A guide bore 66E is shaped substantially into double holes so as to set the changeover lever 65 selectively at a manual reset position or an automatic reset position. And a pair of protrusions 65B of the changeover lever 65 are fitted into such guide bore 66E. The state illustrated in FIG. 8 corresponds to a manual reset mode. An automatic reset mode is selected by rotating the changeover lever 65 counterclockwise with its fore end 65C pressing down the upper surface of the normally open fixed contact element 59.

Overall Operation

A description will now be given on the overall operation performed in the thermally-sensible overcurrent protective relay 100 according to the preferred embodiment of the invention with reference to FIGS. 8 through 17.

In FIG. 12, a main circuit current flows from the main circuit terminal for the power supply side 40 via the heater 4, the bimetal 3 and the bimetal retainer 50 to the load-side main circuit terminal 5. An electric wire (not shown) is connected with the terminal screw 7 fastened to one end 5B of the L-shaped load-side main circuit terminal 5, and its other end is connected to a load (not shown) such as an induction motor. Consequently, the main circuit current corresponds to the load current.

Due to the Joule heat loss caused by such main circuit current flowing through the bimetal 3 and the heater 4, the bimetal 3 is hea{ed and curved, or bent as represented by a dotted line in FIG. 8. This phenomenon is the same as in the aforementioned conventional example shown in FIG. 1.

Toggle Mechanism

Upon occurrence of an overload condition in the load, the main circuit current becomes higher than the above-described value to further increase the curvature of the bimetal 3 as represented by the dotted line in FIG. 8, hence causing its further leftward displacement as viewed in FIG. 8. As a result the communicating plate 8 is pressed by the fore end of the bimetal 3 and is thereby displaced leftward in FIG. 8.

The temperature compensating bimetal 54 thus pressed leftward at its lower end 54 by the left end of the communicating plate 8 is rotated clockwise around the first fulcrum 55A of the lever supporting member 55. Due to such rotary motion, the through hole 54B formed in the temperature compensating bimetal 54 is shifted rightward, as viewed in FIG. 8. When the temperature compensating bimetal 54 thus rotated has reached a dead center point where the axis of the tension coil spring 57 in FIG. 8 or a straight line passing through the hole 54B in the temperature compensating bimetal and the hole 56B in the movable contact element is displaced rightward beyond a straight line passing through the hole 56B in the normally-closed movable contact element 56 and the second fulcrum 55B of the lever supporting member 55, then the tensile force of the coil spring 57 exerted to elastically urge the normally closed movable contact element 56 is directionally changed. Therefore, the normally-closed movable contact element 56 is quickly rotated clockwise around the second fulcrum 55B of the lever supporting member 55. Until arrival of the temperature compensating bimetal 54 at the dead center point in this stage, the tensile force of the coil spring 57 is exerted for elastically urging the normally-closed movable contact element 56 counterclockwise around the second fulcrum 55B, thereby maintaining abutment of the contact point 56C against the contact point 59B. Further, the normally-closed fixed contact element 59 is pressed leftward in FIG. 8 by the tensile force of the coil spring 57 and then is brought to a halt position in abutment against the protrusion 63E of the second lever 63. In this manner, the normally-closed movable contact element 56 constitutes a toggle mechanism in cooperation with the tensile force of the coil spring 57. When the quick clockwise rotation of the normally-closed movable contact element 56 is effected beyond the dead center point as mentioned, the distal end 59C of the normally-closed fixed contact element 59 is allowed to follow the normally-closed movable contact element 56 up to a position in abutment against the protrusion 63D of the second lever 63 and then is restricted at such position. Thereafter, the normally-closed movable contact element 56 is continuously rotated clockwise so that the two contact points 56C and 59B are separated from each other to eventually open the normally-closed contacts.

Overtravel of Normally-Closed Contacts

An overtravel of the normally-closed contacts is determined by the follow-up distance of the normally-closed fixed contact element 59 with respect to the normally-closed movable contact element 56 in the displacement from the position of abutment of the normally-closed fixed contact element 59 against the protrusion 63E of the second lever 63 to the position in abutment thereof against the protrusion 63D, and such overtravel is effective to enhance the contacting reliability of the normally-closed contacts.

Overtravel of Normally-Open Contacts

With such quick clockwise rotation of the normally-closed movable contact element 56 mentioned above, the first lever 62 pressed rightward in FIG. 8 at its lobe 62F by the distal end 56D of the normally-closed movable contact element 56 is rotated counterclockwise around the projecting shaft 1Z. Therefore, the normally-open movable contact element 25 is pressed and deformed by the lobe 62G of the first lever 62, so that the contact point 25B is brought into abutment against the contact point 24A of the normally-open fixed contact element 24, thereby closing the normally-open contacts. Since the normally-open fixed contact element 24 is fabricated by a thin metal plate having sufficient elasticity, it is continuously pressed by the lobe 62G of the first lever 62 even after closing the contacts and is thereby further deformed upward together with the normally-open movable contact element 25. Such deformation proceeds successively until abutment of the normally-open fixed contact element 24 against the first protrusion 64B of the reset bar 64 and is ceased upon abutment of the normally-open fixed contact element 24 against the first protrusion 64B of the reset bar 64. At the position of such cease, the rotary motions of both the normally-closed movable contact element 56 and the first lever 62 are brought to a halt to complete the inversion or trip. The overtravel of the normally-open contacts is determined by the amount of deformation of the normally-open fixed contact element 24 after closing the normally-open contacts posterior to abutment of the contact point 25B against the contact point 24A (i.e. by the gap between the normally open fixed contact element 24 and the first protrusion of the reset bar 64 in the initial state of FIG. 8), and such overtravel is effective to enhance the contacting reliability of the normally-open contacts.

Due to the deformation of the normally-open fixed contact element 24 and the normally-open movable contact element 25 within the distance of such overtravel, the contact points 24A and 25A are caused to mutually slide horizontally in FIG. 8, hence removing any dust, dirt, oxide and so forth from the respective surfaces to eventually enhance the contacting reliability of the normally-open contacts.

Condition Displaying

In the stage of completion of the inversion or trip as mentioned above, the first lever 62 is at the extreme position of its counterclockwise rotation and therefore, the third arm 62D is also at the leftward extreme position, so that the display tip 62J at the fore end of the third arm 62D is hidden behind the wall 1V of the case 1 and is rendered invisible after completion of the inversion or trip, although it is visible in the initial state of FIG. 8 from outside through the window 1A of the case 1. Thus, the display tip 62J has a function of indicating a non-inverted or reset state when visible from outside through the window 1A of the case 1 and an inversion or trip completed state when invisible.

In addition to such operation-state indicating function, the display tip 62J has another function of executing a test trip. Generally, after the overcurrent protective relay of this type performs its contact inversion in response to an overload, a test trip is executed to check whether the normally-closed and normally-open contacts are properly connected with an external circuit to perform a required operation. In such a case, the contacts alone can be actuated by the display tip 62J without causing any current flowing in the main circuit.

Test Tripping

In the thermally-sensible overcurrent protective relay 100 according to the preferred embodiment, test tripping is carried out by the following procedure.

In the initial state illustrated in FIG. 8, the display tip 62J is manually displaced leftward in FIG. 8 by an external means. Then, the first lever 62 is rotated counterclockwise so that its lobe 62E presses the distal end 56D of the normally-closed movable contact element 56 rightward, as viewed in FIG. 8. When the hole 56B in the normally-closed movable contact element 56 has been shifted to the right beyond a straight line passing through the first fulcrum 55A and the second fulcrum 55B of the lever supporting member 55, the tensile force of the coil spring 57 is suddenly exerted in the reverse direction to consequently cause quick clockwise rotation of the normally-closed movable contact element 56. With such rotation of the normally-closed movable contact element 56 similar to the aforementioned inversion, the first lever 62 is rotated so that the normally-closed movable contact element 56 is inverted to complete the test trip.

Subsequent to completion of such test trip, the reset bar 64 is manually depressed downward in FIG. 8 against the elasticity of the return spring 67. As a result, the first protrusion 64B of the reset bar 64 presses the lobe 62G of the first lever 62 downward in FIG. 8 via the normally-open fixed contact element 24 and the normally-open movable contact element 25. Then, the first lever 62 is rotated clockwise around the projecting shaft 1Z so that the normally-closed movable contact element 56 is displaced leftward while being pushed by the lobe 62F. When the hole 56B in the normally-closed movable contact element 56 has been shifted to the left beyond a straight line passing through the first fulcrum 55A and the second fulcrum 55B of the lever supporting member 55, the elastic urge of the tension coil spring 57 exerted clockwise on the normally-closed movable contact element 56 is suddenly reversed to be counterclockwise, whereby the normally-closed movable contact element 56 is rotated counterclockwise to return to the initial state illustrated in FIG. 8. Consequently, the distal end 56D of the normally-closed movable contact element 56 pushes the lobe 62E of the first lever 62, which is thereby quickly rotated clockwise to resume the initial reset state as illustrated in FIG. 8, hence opening the normally-open contacts and closing the normally-closed contacts.

Opening Normall-Closed Contacts

A description will now be given on how the normally-closed contacts are opened.

In the initial state as illustrated in FIG. 8, such operation is performed by manually depressing the reset bar 64 downward in FIG. 8. When the reset bar 64 is depressed against the elasticity of the return spring 67, the second protrusion 64C of the reset bar 64 is brought into abutment against the fore end 63F of the second arm 63C of the second lever 63 to push the same downward. Accordingly, the second lever 63 is rotated clockwise, as viewed in FIG. 8, around the projecting shaft 1Z against the elasticity of the second spring portion 61B of the contact spring 61, so that the protrusion 63D of the second lever 63 comes to press the distal end 59C of the normally-closed fixed contact element 59 leftward. Consequently, the normally-closed fixed contact element 59 is deformed leftward. In this stage, the normally-closed movable contact element 56 follows the normally-closed fixed contact element 59 up to a position where the first lever 62 is rotatable clockwise, i.e., to a position where the lobe 62G of the first lever 62 abuts against the stopper 1T of the case 1. Thereafter, however, the normally-closed movable contact element 56 is restrained with its distal end 56D abutting against the lobe 62E of the first lever 62 and thereby ceases the follow-up action, so that the contact points 56C and 59B are separated from each other to thus open the normally-closed contacts. Upon release of the reset bar 64 from the manual pressure, the reset bar 64 is returned to the former position thereof, as illustrated in FIG. 8. Accordingly, the second lever 63 is also released and returned to the former position of FIG. 8 by the elastic urge of the second spring portion 61B of the contact spring 61, whereby the normally-closed contacts are closed.

Figure 1:
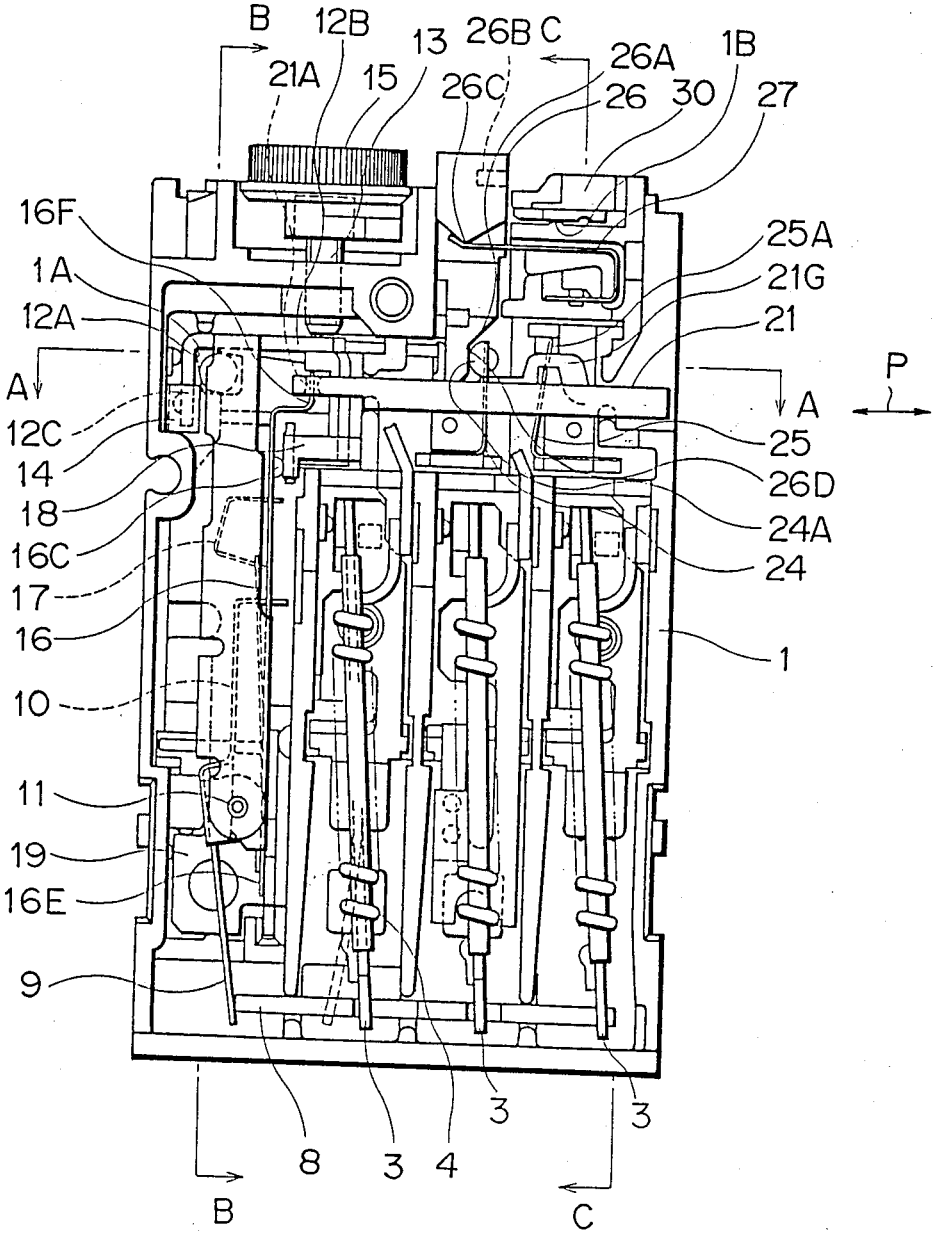
FIG. 1 PRIOR ART
FIG. 1 is a front view of a conventional thermally-sensible overcurrent protective relay shown with its cover removed.
Figure 2:
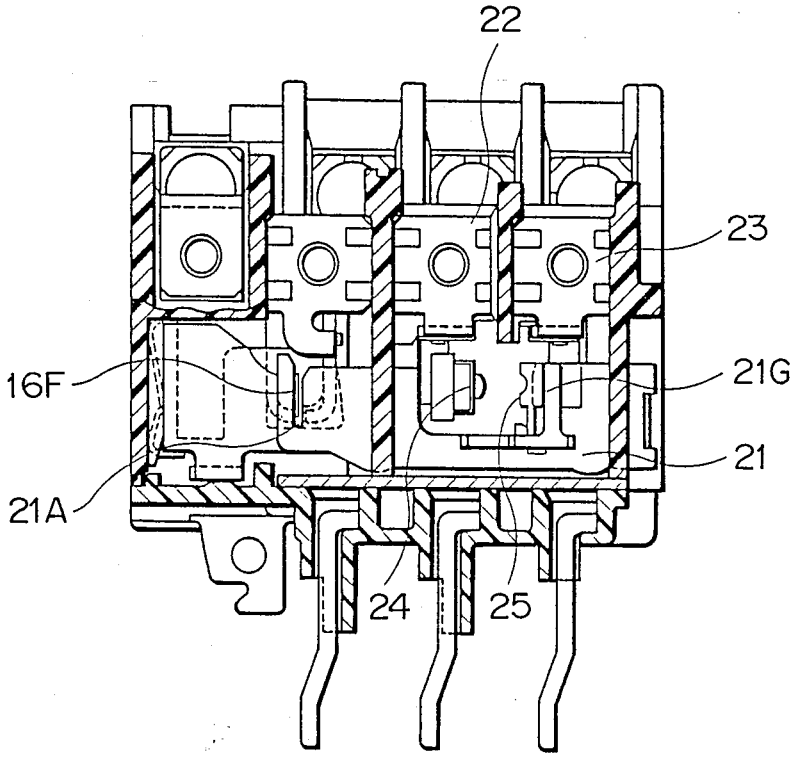
FIG. 2 PRIOR ART
FIG. 2 is a cross-sectional view taken along a line A—A in FIG. 1.
Figure 3:
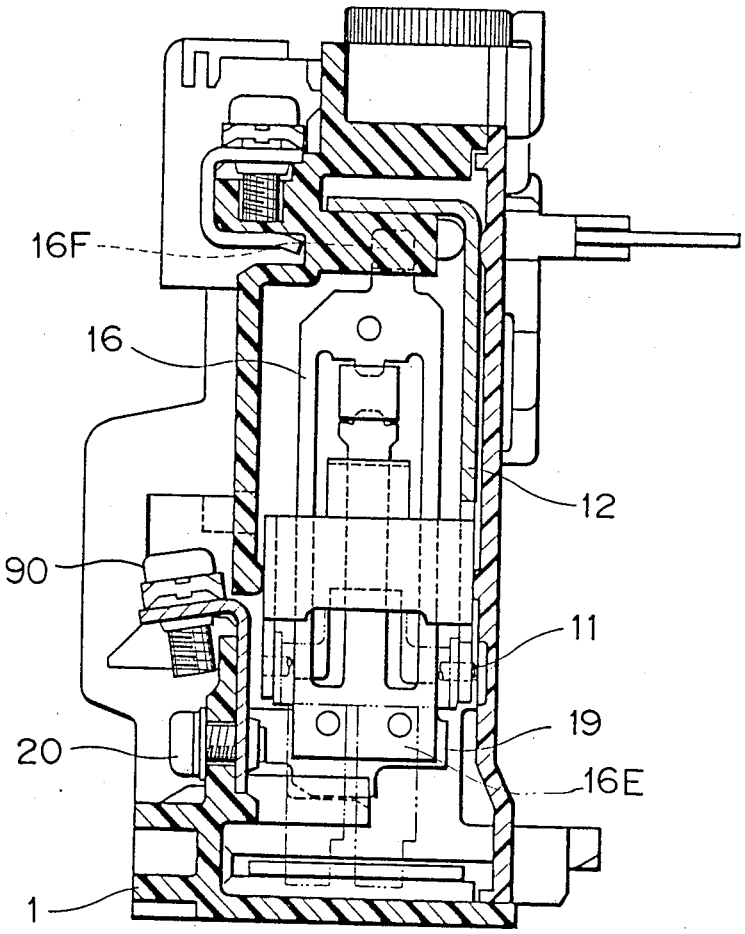
FIG. 3 PRIOR ART
FIG. 3 is a longitudinal sectional view taken along a line B—B in FIG. 1.
Figure 4:
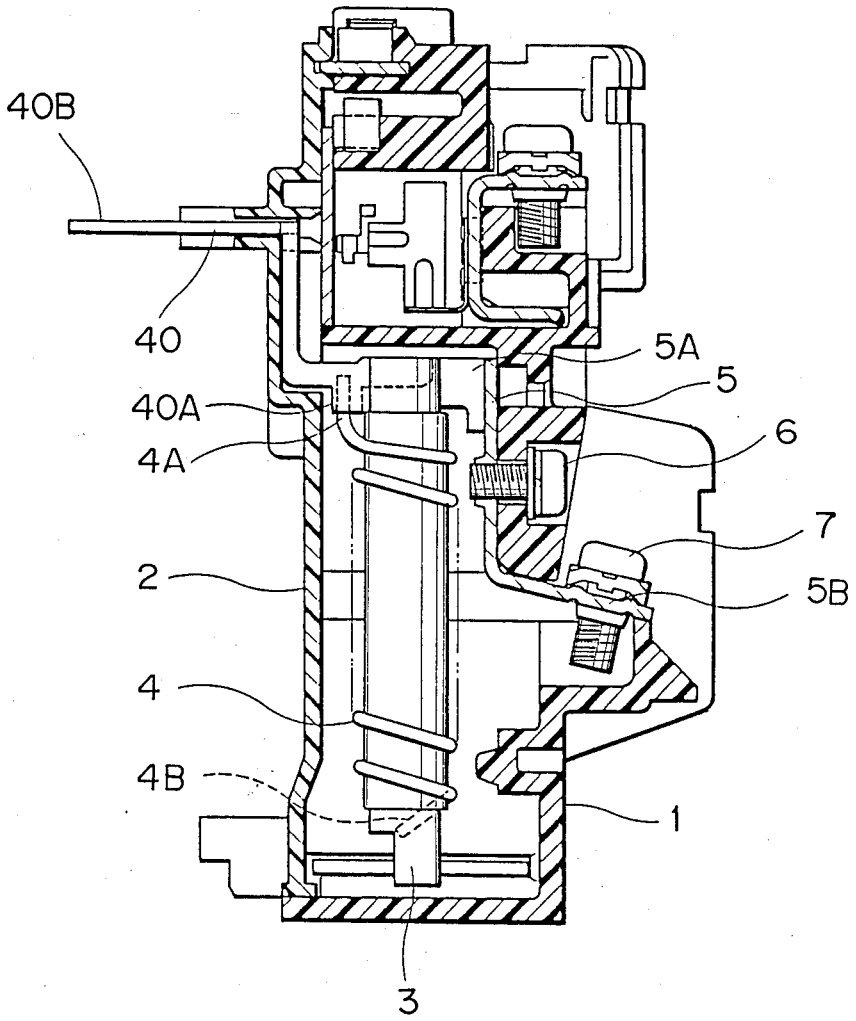
FIG. 4 PRIOR ART
FIG. 4 is a longitudinal sectional view taken along a line C—C in FIG. 1.
Figure 5:
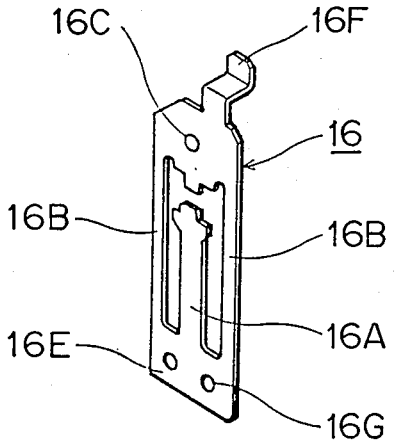
FIG. 5 PRIOR ART
FIG. 5 perspective view of a movable contact element employed in the conventional thermally-sensible overcurrent protective relay.
Figure 6:
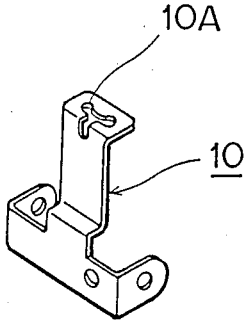
FIG. 6 PRIOR ART
FIG. 6 is a perspective view of an actuating lever employed in the conventional thermally-sensible overcurrent protective relay.
Figure 7:
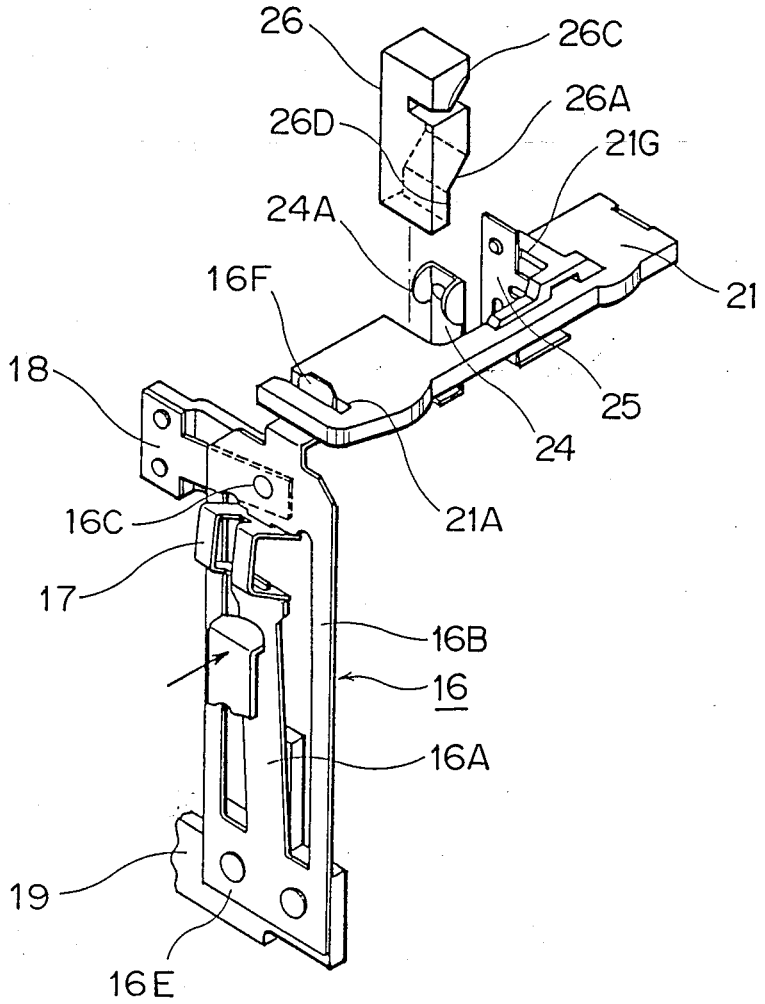
FIG. 7 PRIOR ART
FIG. 7 a perspective view illustrating basic component elements of a snapping inverter employed in the conventional thermally-sensible overcurrent protective relay.

Similar to the conventional thermally-sensible overcurrent protective relay shown in FIG. 1, the normally-closed contact elements 56 and 59 are connected in series with the operating coil circuit of an electromagnetic contactor (not shown) which serve to switch a main circuit current, and the normally-open contacts are used for switching an alarm lamp (not shown).

The thermally-sensible overcurrent protective relay 100 including the improved wire-connecting terminal 80 and the reliable movable contact 56 will now be summarized with reference to FIGS. 8 and 12.

As illustrated in FIG. 8, the thermally-sensible overcurrent protective relay 100 of the preferred embodiment is characterized by comprising the movable contact 56 adapted to conduct a reverse operation and forming the toggle mechanism, the lever supporting member 55 for mechanically supporting the movable contact 56 at its fulcrum portion and electrically connecting the movable contact 56, and the terminal 60 for the movable contact fixed to the case 1 for supplying current through the contact spring 61 for electrically connecting the lever supporting member 55. Even when the position of the terminal 60 as illustrated in FIGS. 9 and 12 is changed by the rotation of the terminal screw 80 as illustrated in FIG. 12, the position of the lever supporting member 55 is not changed and the operational point is not therefore changed, since the first spring portion 61A of the contact spring 61 and the terminal 60 are not fixed to each other, but contact with each other. Accordingly, the thermally-sensible overcurrent protective relay 100 may be manufactured greatly stable.

Furthermore, the lever supporting member 55 includes a mechanism adapted to be rotated at its end portion by the rotation of the adjusting screw 13 shown in FIG. 8 for adjusting the operation current, and the current is flown through the contact spring 61 to the movable contact 56. Therefore, the operation current adjusting portion and the supporting portion of the movable contact 56 may be used in common, thereby reducing the total number of parts and manufacturing the inexpensive overcurrent protective relay.

Although the contact spring 61 was formed by a leaf spring in the preferred embodiment, a compression coil spring or a tension coil spring may be used for the contact spring 61 according to the present invention.

As described above, the thermally-sensible overcurrent protective relay 100 of the present invention comprises the movable contact adapted to conduct a reverse operation and forming the toggle mechanism, the lever supporting member for mechanically supporting the movable contact at its fulcrum portion and electrically connecting the movable contact, and the terminal for the movable contact fixed to the case for supplying current through the contact spring for electrically connecting the lever supporting member. With this construction, the mechanical and electrical connection between the lever supporting member and the terminal for the movable contact is provided by way of the contact spring, and when the wire connecting terminal screw is tightened to connect the wiring, the tightening force is buffered by the contact spring, thus preventing the slippage of the start point of the toggle mechanism.

What is claimed is:

1. A thermally-sensitive overcurrent protective relay comprising:

a housing case;

a bimetal strip bendable in response to an operating current flowing through a control circuit of said overcurrent protective relay;

a movable contact biased by a spring to form a toggle mechanism operable in response to bending of said bimetal strip;

a lever supporting bracket for mechanically supporting said movable contact at a fulcrum portioon of said lever supporting bracket and electrically connected to said movable contact, said lever supporting bracket including an adjustment mechanism, said adjusting mechanism rotatable at an end portion thereof by turning an adjusting screw for adjusting said operating current; and a terminal connected to said movable contact, and fixed to said housing case for supplying said operating current to said control circuit through a contact spring for electrically connecting said lever supporting bracket.

* * * * *